US007665963B2

(12) United States Patent
Bogue et al.

(10) Patent No.: US 7,665,963 B2
(45) Date of Patent: Feb. 23, 2010

(54) CURVED VARIABLE PITCH WEDGE RETENTION IN VANE OUTER BASE

(75) Inventors: William Bogue, Hebron, CT (US); Bruce A. McCollum, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/519,637

(22) Filed: Sep. 12, 2006

(65) Prior Publication Data

US 2008/0063521 A1 Mar. 13, 2008

Related U.S. Application Data

(63) Continuation-in-part of application No. 11/516,391, filed on Sep. 6, 2006, now abandoned.

(51) Int. Cl.
*F01D 5/30* (2006.01)

(52) U.S. Cl. ..... 415/191; 415/209.3; 415/209.4; 416/219 R; 416/241 A; 29/888.02

(58) Field of Classification Search ..... 415/191, 415/200, 208.1, 209.3, 209.4, 210.1, 211.2; 416/219 R, 241 A; 29/888.02
See application file for complete search history.

(56) References Cited

U.S. PATENT DOCUMENTS

| | | | | |
|---|---|---|---|---|
| 2,834,537 | A * | 5/1958 | Neary | 415/209.2 |
| 2,857,093 | A * | 10/1958 | Warnken | 415/209.3 |
| 3,339,833 | A * | 9/1967 | Bill et al. | 416/219 R |
| 3,778,185 | A * | 12/1973 | Plowman et al. | 415/209.4 |
| 4,907,946 | A * | 3/1990 | Ciokajlo et al. | 415/209.3 |
| 5,074,752 | A * | 12/1991 | Murphy et al. | 415/209.4 |
| 5,083,900 | A * | 1/1992 | Carletti et al. | 415/209.3 |
| 5,547,342 | A * | 8/1996 | Furseth et al. | 415/200 |
| 5,569,019 | A | 10/1996 | Katariya | |
| 2007/0098557 | A1 * | 5/2007 | Barnett et al. | 416/193 A |
| 2007/0248463 | A1 * | 10/2007 | Bogue et al. | 416/219 R |

FOREIGN PATENT DOCUMENTS

| | | | |
|---|---|---|---|
| EP | 171329 | A1 * | 2/1986 |

OTHER PUBLICATIONS

European Search Report, Application No. 07253600.6-2315.

* cited by examiner

*Primary Examiner*—Igor Kershteyn
(74) *Attorney, Agent, or Firm*—Bachman & LaPointe, P.C.

(57) ABSTRACT

A method for repairing or replacing a mechanically retained vane is provided. The method comprises the steps of forming an oversized cavity in an outer base, inserting a flared end of a vane in the oversized cavity, and inserting a wedge for mechanically retaining the flared end of the vane in the oversized cavity. The wedge has a first surface with a constant pitch angle to match the outer base cavity and a second surface with a variable pitch angle to match the vane tip dovetail.

21 Claims, 4 Drawing Sheets

CURVED VARIABLE PITCH WEDGE RETENTION IN VANE OUTER BASE

CROSS REFERENCE TO RELATED APPLICATION(S)

The present application is a continuation-in-part application with U.S. Ser. No. 11/516,391, entitled CURVED VARIABLE PITCH WEDGE RETENTION IN VANE OUTER BASE, filed Sep. 6, 2006.

BACKGROUND OF THE INVENTION (1) Field of the Invention

The present invention relates to a method for replacing outer bases for vane assemblies with mechanically retained vanes and a turbine engine component resulting from the method.

(2) Prior Art

As shown in FIGS. 1 and 2, an outlet guide vane assembly 10 used in gas turbine engines has an inner composite base 12 and an outer composite base 14 that positions composite vane airfoils 16 during service. The assembly is bolted to the inner diameter of a cylindrical metal case (not shown) by three bolts extending thru the case and the outer base. The inner base is bonded to the vane airfoil and is inseparable without destroying the inner base. The outer base to vane end interface is a bonded assembly which incorporates mechanical retention where the vane end 18 is flared and the vane cavity 20 in the outer base 14 pinches. The vane airfoil is both bonded to and mechanically retained by the outer base. The result is that the vane 22 cannot fall through the base 14 without material rupture of the base and/or vane. The metallic case (not shown) prevents movement of the flared vane end 18 in the outboard direction.

The mechanical retention feature prevents installation of replacement outer base detail without complete removal and replacement of the inner base 12 because neither the inner base, nor the flared vane end 18 can fit through the pinched vane cavity 20.

The outer base is the feature most prone to impact and flexural damage as a result of fan blade centrifuged objects and fan case flexure. Accordingly, there is a need for an economic method for replacing damaged outer bases.

SUMMARY OF THE INVENTION

In accordance with the present invention, there is provided an economic method for repairing or replacing a mechanically retained vane. The method broadly comprises the steps of forming a cavity in an outer base oversized sufficiently to insert a flared end of a vane radially outward through the outer base oversized cavity and installing a curved variable pitch wedge having a first constant pitch surface and a second variable pitch surface between the outer base and the flared vane end to secure the flared vane end in position.

Further, in accordance with the present invention, there is provided a turbine engine component comprising an outer base structure, a cavity within the outer base, at least one airfoil surface having an end positioned within the cavity, and means positioned within the cavity for mechanically retaining the end of the at least one airfoil surface within the cavity, which retention means comprises a wedge having a first constant pitch surface contacting a wall of said cavity and a second variable pitch surface abutting said vane end.

Other details of the curved variable pitch wedge retention in a vane outer base, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
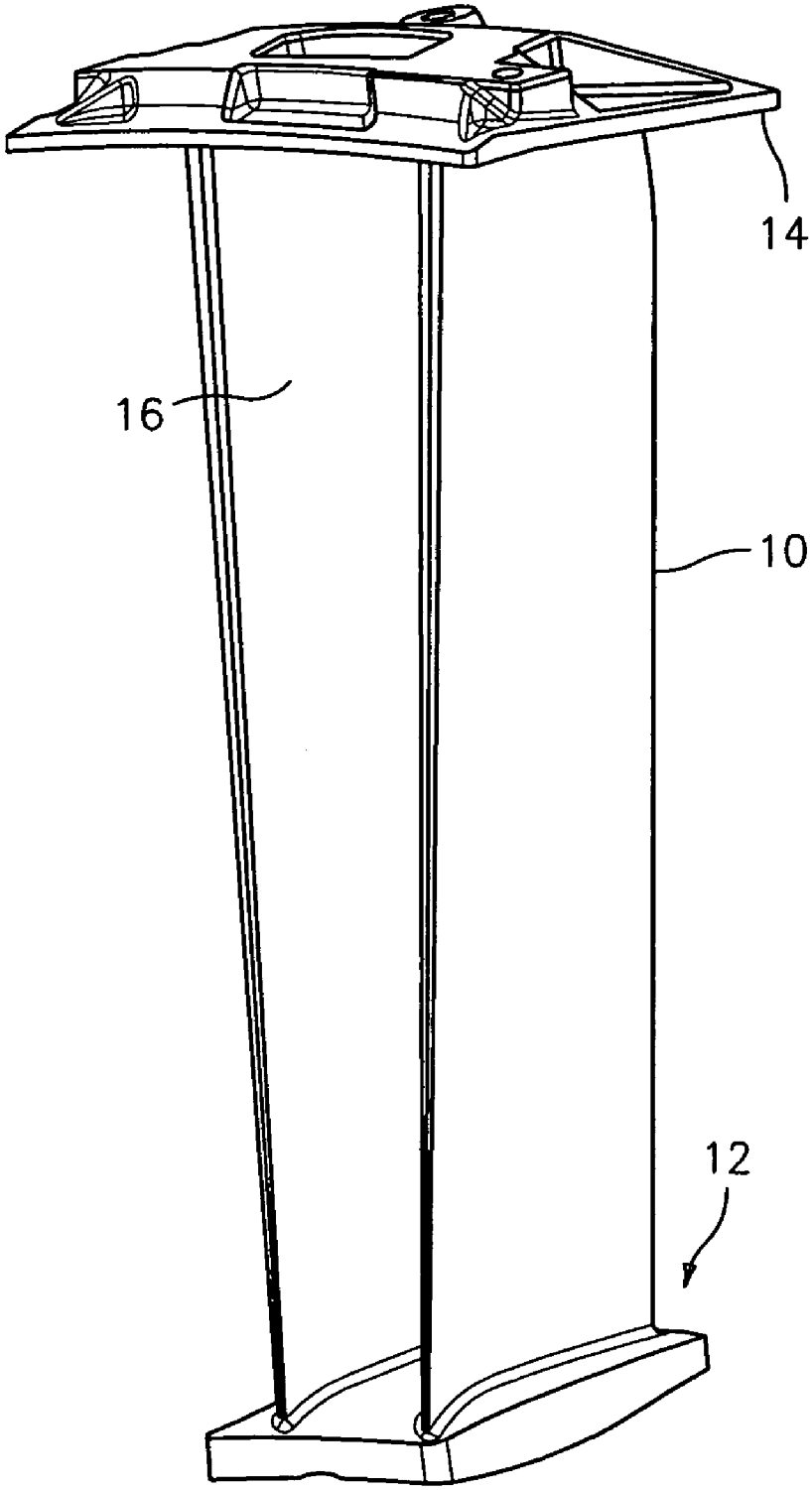
FIG. 1 is a perspective view of an outlet guide vane assembly used in a gas turbine engine.
Figure 2:
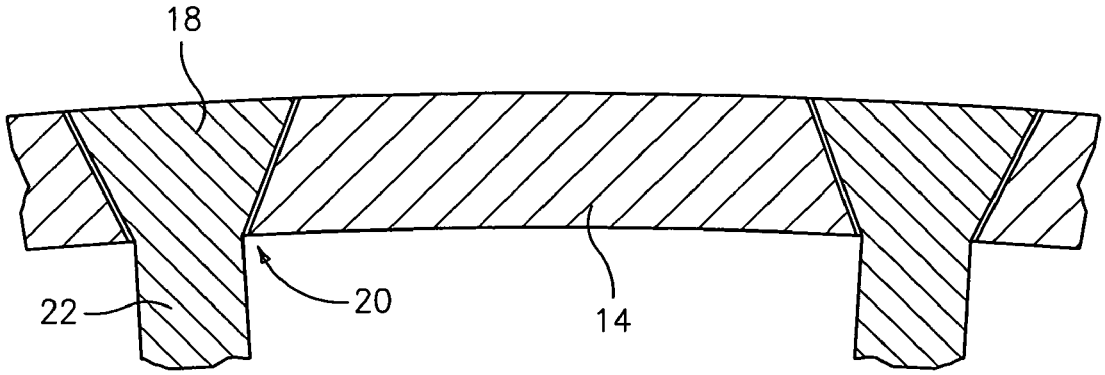
FIG. 2 is a sectional view of a prior art mechanical retention system for positioning airfoil surfaces of a vane used in the outlet guide vane of FIG. 1.
Figure 3:
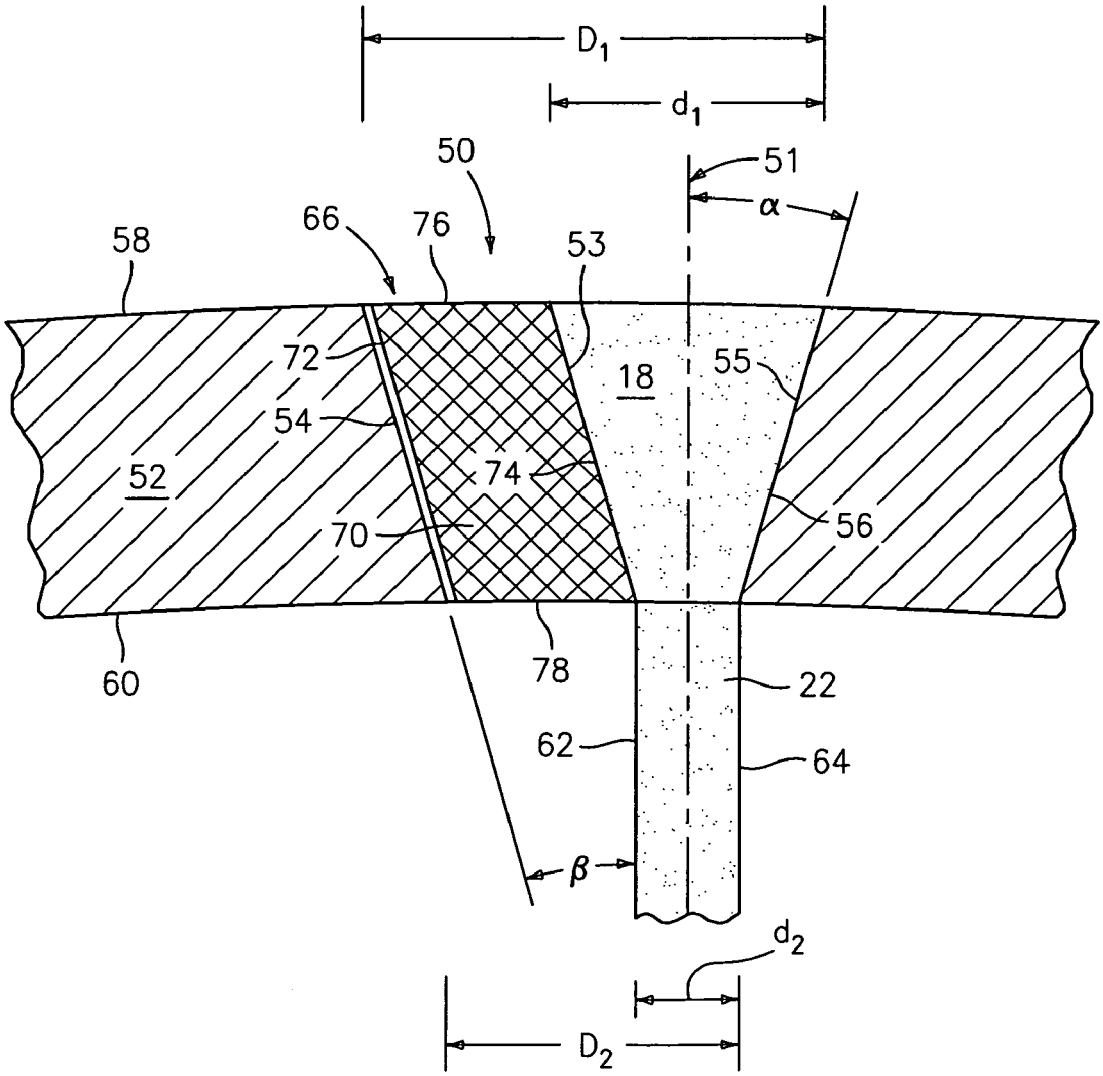
FIG. 3 is a sectional view of a mechanical retention system for positioning airfoil surfaces of a vane used in the outlet guide vane of FIG. 1 in accordance with the present invention.
Figure 4:
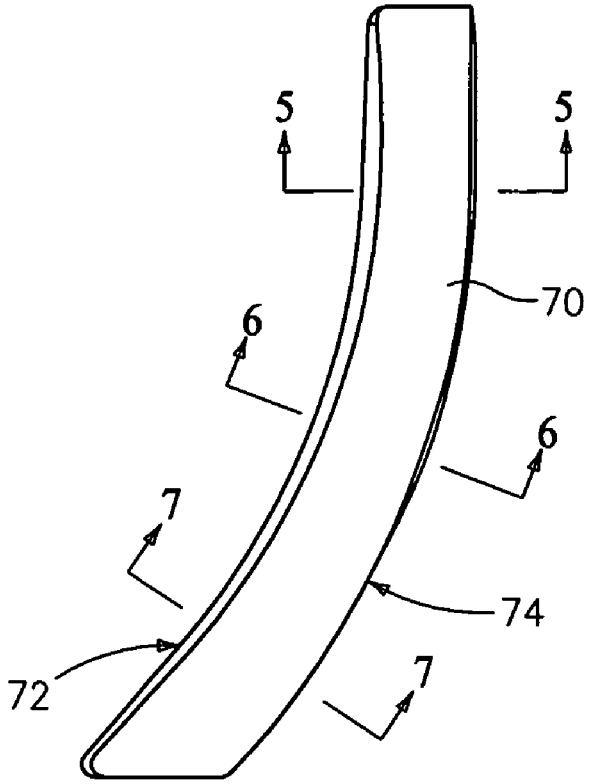
FIG. 4 illustrates a curved variable pitch wedge.
Figure 5:
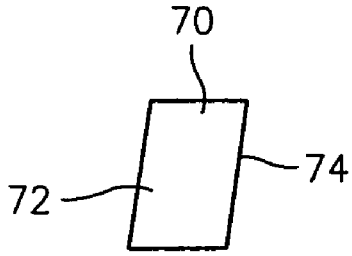
FIG. 5 is a sectional view taken along lines 5-5 in FIG. 4.
Figure 6:
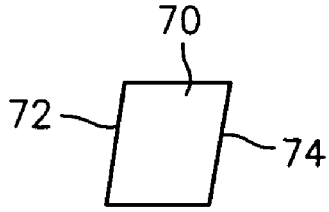
FIG. 6 is a sectional view taken along lines 6-6 of FIG. 4.
Figure 7:
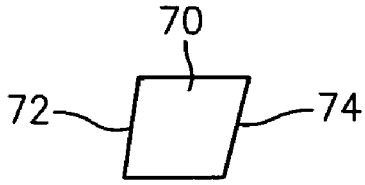
FIG. 7 is a sectional view taken along lines 7-7 of FIG. 4.

Referring now to FIG. 3, there is shown a mechanical retention system for positioning airfoil surfaces of a vane in a turbine engine component, such as an outlet guide vane assembly.

The mechanical retention system comprises an oversized pinch cavity 50 machined or molded into an outer base 52 of a turbine engine component 10, such as the outer composite base of an outlet guide vane. The cavity 50 has curved side walls 54 and 56. The side walls 54 and 56 converge from the outboard edge 58 of the outer base 52 to the inboard edge 60 of the outer base 52. The cavity 50 is sized so that a flared end 18 of a vane airfoil 22 may be installed through the narrow end of the cavity 50 in a radially outward direction.

The flared vane end 18 has curved surfaces 53 and 55. Each of the surfaces 53 and 55 forms a variable pitch angle a relative to the vane stacking line 51. Mechanical retention in the radially inward direction may be maintained by a case wall (not shown).

The flared end 18 of the vane 22 is located within the oversized cavity 50 so as to position the airfoil surfaces 62 and 64 of the vane airfoil 22. The vane end 18 is flared so as to have a first cross-sectional dimension $d_1$ adjacent the outboard edge 58 and a second cross-sectional dimension $d_2$ adjacent the inboard edge 60. The second dimension $d_2$ is less than the first dimension $d_1$. There is a thickness transition between the outboard and inboard edges 58 and 60. The oversized cavity 50 is provided with a dimension $D_1$ adjacent the outer edge 58 and with a dimension $D_2$ adjacent the inner edge 60. $D_1$ is greater than both $D_2$ and $d_1$. $D_2$ is greater than $d_2$. As a result, there is a space 66 between a side wall 54 or 56 of the cavity 50 and a side wall 53 or 55 of the flared end 18.

The flared vane end 18 may be inserted through the inboard opening of the cavity (Dimension D2). In order to retain the end 18 in place, a wedge detail 70 is inserted into the space 66. The wedge detail 70 is installed from the large end of the cavity 50. The wedge detail 70 is contoured to occupy the space 66 which is the difference between the oversize of the cavity 50 and the flared vane end 18.

As shown in FIGS. 4-7, the wedge detail 70 has two side walls 72 and 74 which converge from the outer end 76 to the inner end 78. In a preferred embodiment of the present invention, the side wall 72 has a constant angle or pitch β with respect to the vane stacking line 51, while the side wall 74 is a variable pitch surface for contacting the surface 53 of the flared inner end 18. The constant pitch angle of the side wall 72 helps to simplify geometry of the outer base 52 and further minimize slot-circumferential width. The dovetail angle or the pitch of the side wall 74 varies from the leading edge to the trailing edge of the wedge detail 70 with respect to the vane stacking line 51, complicating the wedge geometry. The variable pitch surface wall 74 is designed to match the existing pitch of the surface 53. In this way, a good bonding surface can be created. It should be appreciated that a space for bonding material may be required between surfaces 54 and 72 and between surfaces 53 and 74.

The wedge detail 70 may be formed from any suitable material known in the art, but in a preferred embodiment, it is fabricated from the same material as the outer base. For example, the wedge detail 70 may be formed from a non-metallic material such as polyurethane; a high performance, glass or carbon fiber reinforced engineering composite molding compound such as the material sold under the trade name LYTEX; nylon; or a polyetherimide such as the material sold under the trade name ULTEM.

At a minimum, the side wall 74 is preferably curved to match the curvature of the flared vane end 18. Typically, both side walls 72 and 74 are curved to maintain the pinch on a vane end 18.

In a preferred embodiment of the present invention, the outer base 52, the wedge detail 70, and the vane end 18 are both mechanically and adhesively secured. Any adhesive compatible with the base, vane and wedge materials known in the art may be used to adhesively secure these elements together. For example, a two part epoxy plastic adhesive such as Hysol EA9394 or EA9394/C-2 paste adhesive manufactured by Loctite Aerospace of Bay Point, Calif. The outer base 52 is preferably formed from an epoxy resim composite material such as LYTEX or an epoxy fiberglass sheet molding compound. For example, a two part epoxy plastic adhesive such as Hysol EA9394 or EA9394/C-2 paste adhesive manufactured by Loctite Aerospace of Bay Point, Calif. The outer base 52 is preferably formed from an epoxy resin composite material such as LYTEX or an epoxy fiberglass sheet molding compound.

In order to repair or replace an outer base in a turbine engine component, the oversized cavity 50 is first machined or formed in an outer base 52 of the turbine engine component 10. The flared end 18 of a vane 22 is then positioned within the oversized cavity 50. An adhesive material in a suitable form may be applied to the walls of the flared end 18 of the vane and to the walls 54 and 56. The adhesive material may also be applied to the walls 72 and 74 of the wedge detail 70. Thereafter, the wedge detail 70 is installed from the large end of the cavity 50. As a result, the mechanical retention that was present in the original turbine engine component 10 is restored. Either the outer base 52, the vane end 18, or the wedge detail 70 must rupture for the vane end 18 to be pulled through the base 52.

Figure 8:
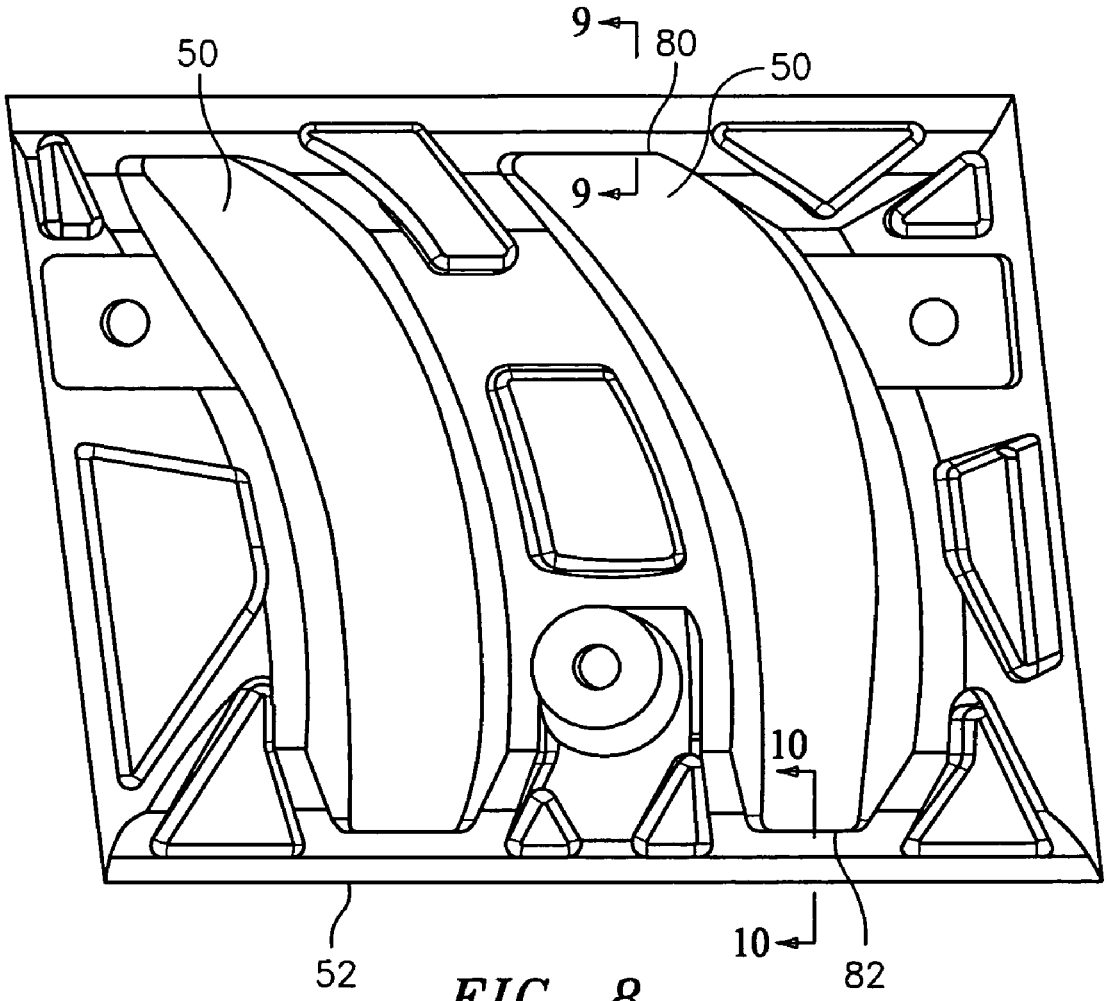
FIG. 8 illustrates an outer base for a turbine engine component.
Figure 9:
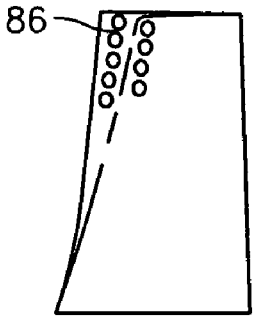
FIG. 9 is a sectional view taken along lines 9-9 of FIG. 8.
Figure 10:
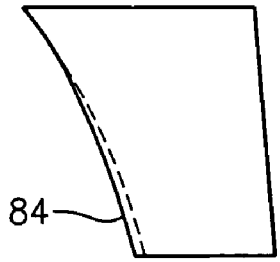
FIG. 10 is a sectional view taken along lines 10-10 of FIG. 8.

FIG. 8 illustrates an outer base 52 having enlarged cavities 50. Each cavity 50 has a leading (forward) edge 80 and a trailing (aft) edge 82. At the leading (forward) and trailing (aft) edges 80 and 82, the enlarged cavity may have additional base material (thickness) 84 or a secondary reinforcing phase 86 such as continuous fiber for reinforcement and/or for minimizing the circumferential width of the cavity.

One of the advantages of the present invention is that the mechanical retention is maintained, but complete disassembly of the vane and inner bases is not required. This allows for reduced tooling and inspection requirements without degradation of technical merit. Additionally, for vane assemblies with more than one vane airfoil, the relative positioning of vanes is maintained by the inner base simplifying the assembly process and reducing the opportunity for incorrect positioning of the vanes in the finished assembly.

While the retention system of the present invention has been described as being used in connection with the positioning of airfoil surfaces of vanes in an outlet guide vane, it should be recognized that the retention system could be used in other turbine engine components to position surfaces of blades, vanes, and other radial elements.

It is apparent that there has been provided, in accordance with the present invention, a curved variable pitch wedge retention in vane outer base which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A method for repairing or replacing a mechanically retained vane comprising the steps of:

forming a cavity in an outer base oversized sufficiently to insert a flared end of a vane radially outward in said outer base oversized cavity, inserting the flared end of the vane in said outer base oversized cavity so that a first wall of said flared end abuts a first side wall of said cavity, and installing a curved variable pitch wedge having a first constant pitch surface and a second variable pitch surface between the outer base and the flared vane end to secure the flared vane end in position.

2. The method according to claim 1, wherein said forming step comprises forming a cavity having a larger dimension adjacent an outer edge of said outer base and a smaller dimension adjacent an inner edge of said outer base.

3. The method according to claim 2, wherein said installing step comprises installing said curved variable pitch wedge between a second side wall of said cavity and a second wall of said flared end of said vane.

4. The method according to claim 3, wherein said installing step comprises installing said wedge so that said constant pitch surface abuts said second side wall.

5. The method according to claim 3, wherein said installing step comprises installing said wedge so that said variable pitch surface abuts the second wall of said flared end of said vane.

6. The method according to claim 3, wherein said installing step comprises installing said wedge into an end of said cavity having said larger dimension.

7. The method of claim 1, further comprising applying an adhesive to walls of said cavity, said walls of said flared end, and said wedge surfaces so as to secure said flared end of said vane and said wedge to said side walls of said cavity and said outer base.

8. The method according to claim 7, wherein said adhesive applying step comprises a two part epoxy paste adhesive.

9. A turbine engine component comprising:

an outer base, a cavity within said outer base, said cavity having first and second side walls, an airfoil surface having a flared end positioned within said cavity for mechanically retaining said end of said at least one airfoil surface within said cavity, said flared end having a first wall abutting said first cavity side wall, and means positioned within said cavity for mechanically retaining said end of said at least one airfoil surface within said cavity, said mechanical retaining means comprising a wedge having a first surface with a constant pitch angle and a second surface having a variable pitch angle.

10. The turbine engine component of claim 9, wherein said outer base has an outer edge and an inner edge and said cavity has a larger dimension adjacent said outer edge and a smaller dimension adjacent said inner edge and said cavity being larger than said flared end.

11. The turbine engine component of claim 9, wherein said wedge is positioned between the second side wall of said cavity and a second wall of said flared end.

12. The turbine engine component of claim 11, wherein said vane, said wedge and said outer base are each formed from a non-metallic material.

13. The turbine engine component of claim 12, wherein said wedge is formed from a non-metallic material selected from the group consisting of polyurethane, a high performance glass or carbon fiber reinforced engineering composite molding compound, nylon, and a polyetherimide material.

14. The turbine engine component of claim 11, further comprising an adhesive material for joining said wedge to said flared end, for joining said flared end to said outer base, and for joining said wedge to said outer base.

15. The turbine engine component of claim 14, wherein said adhesive is a two part epoxy paste adhesive and said outer base is formed from an epoxy resin composite material.

16. The turbine engine component according to claim 9, wherein said component comprises an outlet guide vane.

17. The turbine engine component according to claim 9, wherein said outer base comprises an outer base of an outlet guide vane, said outlet guide vane has an inner base, and said vane extends between said inner base and said outer base.

18. The turbine engine component of claim 9, wherein said flared end of said vane has said first and second side walls with a variable dovetail angle with respect to a vane stacking line.

19. The turbine engine component of claim 9, wherein said flared end has a surface with a variable dovetail angle and wherein said variable pitch angle surface of said wedge abuts said vane surface having a variable dovetail angle.

20. The turbine engine component of claim 9, further comprising said cavity having a forward end and an aft end and a structural reinforcement material at said forward and aft ends.

21. The turbine engine component of claim 9, further comprising said cavity having a forward end and an aft end and means for minimizing the circumferential width of the cavity at said forward and aft ends.

* * * * *

UNITED STATES PATENT AND TRADEMARK OFFICE

CERTIFICATE OF CORRECTION

PATENT NO. : 7,665,963 B2
APPLICATION NO. : 11/519637
DATED : February 23, 2010
INVENTOR(S) : Bogue et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 67 days.

Signed and Sealed this

Fourth Day of January, 2011

David J. Kappos

David J. Kappos
*Director of the United States Patent and Trademark Office*